United States Patent [19]

Thorud

[11] 4,436,354

[45] Mar. 13, 1984

[54] FLAT-FILE

[75] Inventor: Stanley R. Thorud, Brooklyn Center, Minn.

[73] Assignee: Liberty Carton Co., Minneapolis, Minn.

[21] Appl. No.: 321,699

[22] Filed: Nov. 16, 1981

[51] Int. Cl.[3] ..... A47B 43/02

[52] U.S. Cl. ..... 312/259; 312/111; 220/22.3; 206/491

[58] Field of Search ..... 312/259, 258, 261; 229/23 R; 206/491, 492; 220/22.3

[56] References Cited

U.S. PATENT DOCUMENTS

| | | | |
|---|---|---|---|
| 930,114 | 8/1909 | Adams | 229/23 R |
| 1,125,902 | 1/1915 | Downey et al. | 312/259 |
| 2,074,315 | 3/1937 | Neely | 229/23 R |
| 2,221,024 | 11/1940 | Hood | 220/22.3 |
| 2,904,382 | 9/1959 | Mitten | 312/259 |
| 3,084,790 | 4/1963 | Lugt, Jr. | 206/491 |
| 3,365,258 | 1/1968 | Downing | 312/258 |
| 3,554,429 | 1/1971 | Cohen | 206/491 |
| 4,080,023 | 3/1978 | Bair | 312/259 |
| 4,319,795 | 3/1982 | Klaus | 312/111 |

*Primary Examiner*—Victor N. Sakran

*Attorney, Agent, or Firm*—Williamson, Bains, Moore & Hansen

[57] ABSTRACT

A flat file having a number of drawers is formed of a shell having a number of shelves therein for locating the various drawers of the flat file. The shelves are located by means of shelf support members formed of corrugated board having portions which are slotted and folded into place so as to locate the shelves.

8 Claims, 5 Drawing Figures

FLAT-FILE

BACKGROUND OF THE INVENTION

Flat files in general have been known for a long time and most typically are constructed of metal. In recent years, flat files constructed of nonmetallic substances such as corrugated board and/or particle board have become popular. Such files typically have a number of shelves therein which serve to locate the drawers of the file. These shelves are typically located inside an outer shell by means of locating devices on either side of the shell. These locating devices may be formed of particle board having slots cut therein for receipt of the shelves or may be formed sets of several thicknesses of corrugated material fastened to the shell in spaced relationship between sets so as to provide slots for the shelves. The latter construction has been less than satisfactory in that such a construction requires very precise location of the corrugated portions so as to provide for the proper spacing of the shelves and therefore the drawers.

It is, therefore, an object of this invention to provide a support member which is easily and inexpensively manufactured and in which the spacing of the shelves can be controlled and dictated to a high degree.

SUMMARY OF THE INVENTION

A rectangular shell has a top, a bottom, a back, an open front and two sides. Overlying each side are first and second support members formed of corrugated fiberboard or the like. Each support member has a portion at the front which is folded backwards overlying the main panel of the support member and which portion is slotted for receipt of shelves for supporting and separating the various drawers. A slotted portion is also folded forward from the rear of the main panel of this support member, this portion having widened slots at the forward edge thereof to ease the insertion of the shelves. A rear center support may also be added and this, too, is formed of corrugated material which is slotted for receipt of the shelves.

These and other objects and advantages of the invention will become readily apparent as the following description is read in conjunction with the accompanying drawings wherein like reference numerals refer to the same or similar parts throughout the several views.

DESCRIPTION OF THE DRAWING FIGURES

DESCRIPTION OF THE PREFERRED EMBODIMENT

Figure 1:
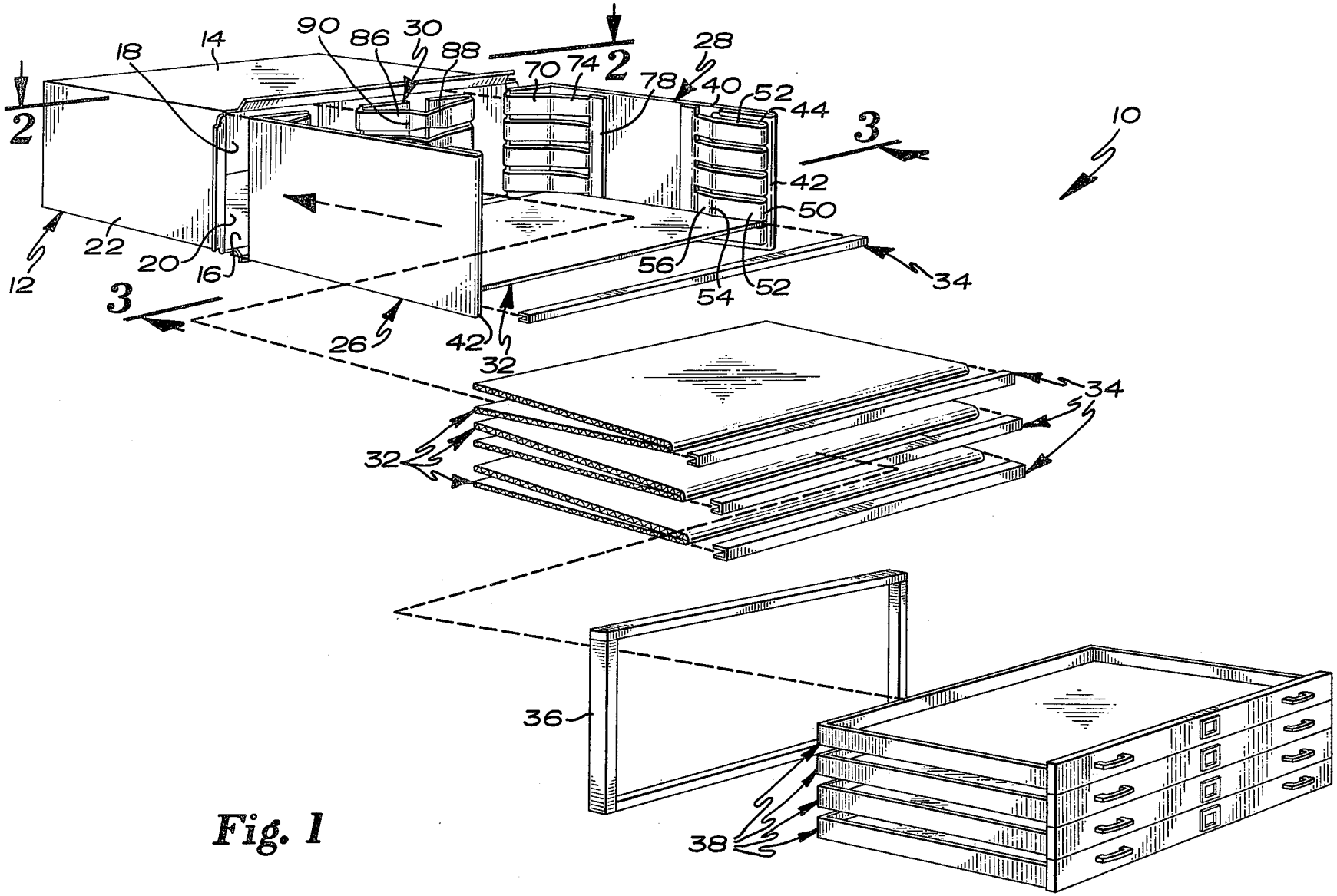
FIG. 1 is an exploded perspective view of the invention.

The flat file, generally 10, is comprised of a shell 12 having a top 14, a bottom 16, a back 18, an open front 20 and first and second sides 22 and 24, respectively. First and second support members 26 and 28, respectively, are placed inside shell 12 and overlie the inner surfaces of first and second sides 22 and 24. The details of support members 26 and 28 are described more fully hereinafter. A rear support member 30 overlies backwall 18. A plurality of shelves 32 are provided for engagement with support members 26, 28 and 30, said shelves 32 being comprised of a double thickness of corrugated board and having, if desired, a channel-shaped metal front edge 34 placed thereover. If desired, a rectangular metal frame 36 frames the open front 20 of shell 12. A number of drawers 38 are thence inserted between shelves 32. The construction of drawers 38 is conventional and may be of several known types in the art.

Figure 2:
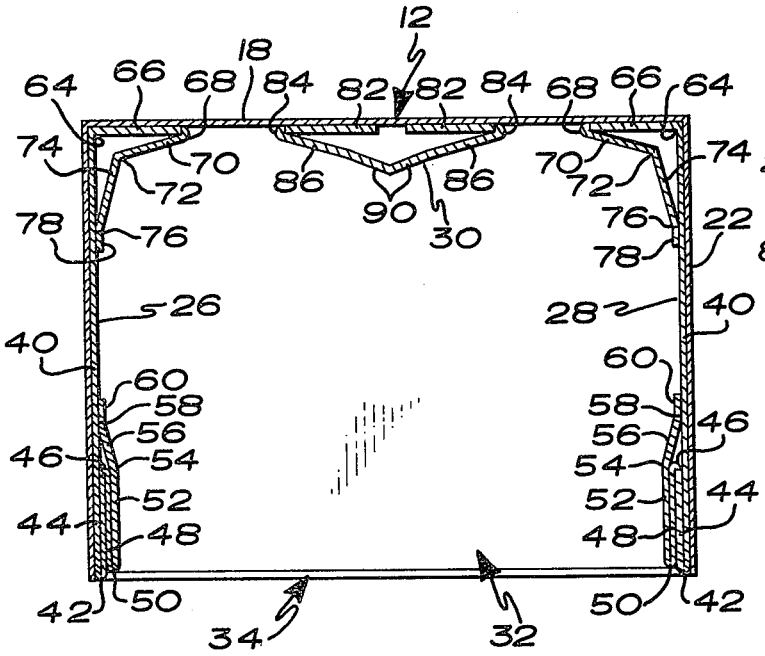
FIG. 2 is a sectional view taken along line 2—2 of FIG. 1.
Figure 5:
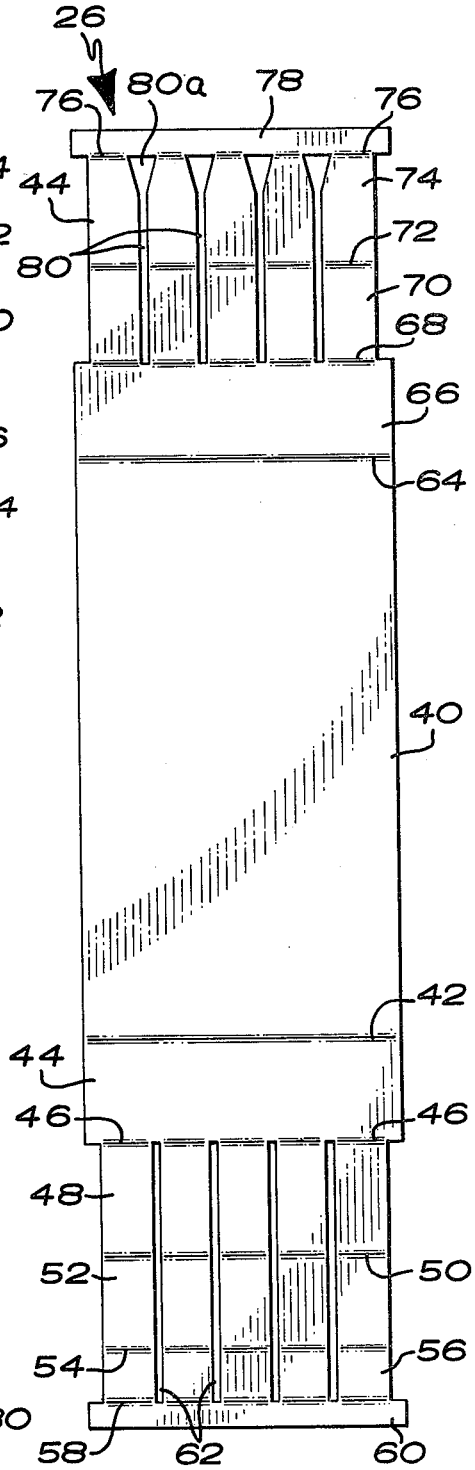
FIG. 5 is a plan view showing the side support member blank.

Turning to FIG. 5, first support member 26 is shown therein in blank form. Of course, it can be appreciated that second support member 28 is, in blank form, identical to first support member 26. As shown in FIG. 5, a support member 26 is comprised of a rectangular main panel 40 having hinged thereto a front spacing panel 44 by means of foldline 42. Hinged to the opposite side of front spacing panel 44 is first front slotted panel 48 which is hingedly attached at foldline 46. Attached to the opposite side of slotted panel 48 is second front slotted panel 52 at foldline 50. Transition panel 56 is attached to the opposite edge of second front slotted panel 52 at fold line 54. Finally, attachment flange 60 is attached at fold line 58 to transition panel 56. A number of slots 62 corresponding to the number of shelves 32 are formed in panels 48, 52, and 56. A rear transition panel 66 is attached at the opposite end of main panel 40 at fold line 64. First and second rear slotted panels 70 and 74 are attached at fold lines 68 and 72, respectively. Attachment flange 78 is attached to panel 74 at fold line 76. Slots 80 are formed in panels 70 and 74, slots 80 corresponding in number to the slots 62 formed at the front of support member 26. As can be seen in FIG. 5, slots 80 have a widened portion **80*a* adjacent attachment flange 78. Widened portion 80*a* serves to ease the insertion of shelves 32 into slots 80. As can be seen in FIG. 2, front transition panel 44 is folded backwards so as to overlie main panel 40. Thence, first slotted panel 48 is folded forward again and second slotted panel 52 folded back with attachment flange 60 being folded into contact with main panel 40** and fastened thereto by any conventional means of attachment such as adhesive, staples, or the like.

Similarly, at the rear end of main panel 40, transition panel 66 is bent at right angles to main panel 40 so as to overlie the rear wall 18 of shell 12. Hence, first slotted panel 70 is bent so as to form an acute angle relative to transition panel 66 and then second slotted panel 74 folded forwardly in conjunction with attachment panel 78 so as to form in effect an angled shelf as shown in FIG. 2.

Figure 4:
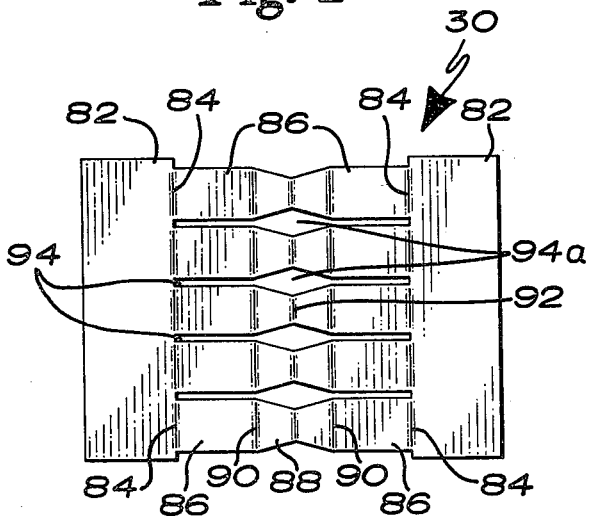
FIG. 4 shows the blank from which the rear support is formed.
Figure 3:
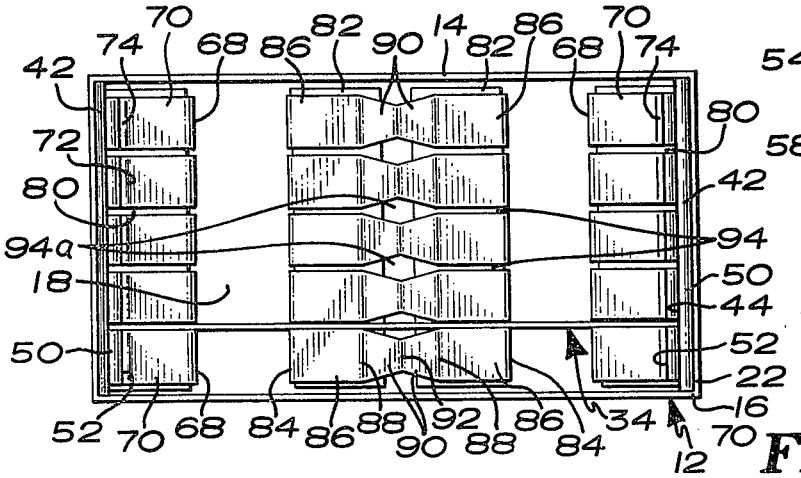
FIG. 3 is a sectional view taken along line 3—3 of FIG. 1.

FIG. 4 discloses rear support member 30 which is comprised of two outer attachment flanges 82 having a rectangular slotted panel 86 attached thereto at fold lines 84 and tapered slotted panels 90 attached to panels 86 at fold lines 88. Each pair of tapered slotted panels 90 is attached to one another at fold line 92. Slots 94 extend through panels 86 and 90 and have widened portions **94*a* which, like widened portions 80*a*, serve to ease initial insertion of shelves 32 into slots 94. As can be seen in FIG. 2, rear support member 30 is folded into a generally triangular shape with attachment flanges 82 forming the base thereof. As shown in FIG. 2, a small angle may be included between panels 90 and 86 is desired. Again, rear support 30 may be attached to shell 12** by means of staples, adhesives, or any other conventional fastening means.

While the preferred embodiments of the present invention have been described, it should be understood that various changes, adaptations and modifications may be made therein without departing from the spirit of the invention and the scope of the appended claims.

What is claimed is:

1. A flat-file having a plurality of drawers located in a shell having a top, a bottom, a back, an open front, first and second sides and at least one shelf located between and parallel to the said top and said bottom, the improvement comprising at least one shelf support member, said shell and said support member being formed of a foldable material, said support member comprising:

a main panel located inside of and parallel to one of said sides; and at least one front shelf support panel attached to the front of said main panel, said front support panel comprising at least one slot therein for engaging and supporting a shelf;

a front spacing panel spacing said front support panel from said main panel, said front support panel and said front spacing panel overlying said main panel; and a rear support panel attached to the rear of said main panel, said rear support panel comprising at least one slot therein for engaging and supporting a shelf.

2. The flat-file of claim 1 further comprising a second support panel overlying and attached to said front support panel.

3. The flat-file of claim 5 further comprising means for fastening said support panels to said main panel.

4. The flat-file of claim 1 further comprising a rear spacing panel, said rear spacing panel being attached to and extending normally inwardly from said main panel and said rear support panel extending forwardly toward said main panel.

5. The flat-file of claim 4 wherein each said panel slot has a widened portion at the forward end thereof.

6. The flat-file of claim 4 further comprising means for fastening said rear support panel to said main panel.

7. The flat-file of claim 1 further comprising a back support member, said back support member being attached to said back and having at least one slot therein for receiving a shelf therein.

8. The flat-file of claim 7 wherein said back support member extends forwardly from said back, each said slot having a widened portion at the front thereof.

* * * * *